United States Patent [19]

Friel et al.

[11] 3,985,642

[45] Oct. 12, 1976

[54] PROCESS OF RECLAIMING LUBE OILS

[75] Inventors: John P. Friel, Lomita; Paul L. Hammond, Richmond, both of Calif.

[73] Assignee: Petrolite Corporation, St. Louis, Mo.

[22] Filed: Apr. 28, 1975

[21] Appl. No.: 572,139

[52] U.S. Cl. ..... 208/180; 208/181

[51] Int. Cl.[2] ..... C10M 11/00

[58] Field of Search ..... 208/180, 181

[56] References Cited

UNITED STATES PATENTS 3,282,827 11/1966 Grysiak ..... 208/180

3,305,478 2/1967 Gilson et al. ..... 208/180

*Primary Examiner*—Delbert E. Gantz

*Assistant Examiner*—James W. Hellwege

*Attorney, Agent, or Firm*—Sidney B. Ring; Hyman F. Glass

[57] ABSTRACT

This invention relates to a process of reclaiming lube oil which comprises treating spent lube oil with a surfactant, preferably an anionic surfactant, in combination with an amine, preferably a polyalkylene polyamine, and recovering the reclaimed oil.

10 Claims, No Drawings

PROCESS OF RECLAIMING LUBE OILS

An important factor in determining the useful life of a lubricant is the presence of contaminants which affect the life and efficiency of the device being lubricated as well as the life of the lubricant. Lubricating oils are called upon to reduce friction, carry away heat, protect against rust, protect against wear, and seal out contaminants and their properties are adversely affected by contamination.

The effects of some of the contaminants referred to briefly are as follows:

1. Water in even small amounts promotes rusting of iron or steel and helps to form water sludges (emulsions) which may clog oil passages, pumps, valves, and other oil-handling equipment. Water contributes to the deterioration of lubricants and uses up any demulsifier additives which may have been incorporated. It may also contribute to foaming problems.

2. Solid abrasive particles of dirt, dust, grit, and metallic fragments circulated by the lubricant obviously have a detrimental effect. Excessive wear, scoring of bearing surfaces, and possible failure due to seizing or metal fatique are commonly the result of this type of contamination. Smaller particles may even become embedded in the soft bearings surfaces, such as engine bearings, and act as a sort of lapping or grinding compound, which action is cumulative and thus greatly accelerates wear. Larger particles score bearing surfaces, which would lead to eventual bearing failure by seizing or fatigue.

3. Sludge, which is a combination of water, dirt, and oil deterioration, produces deposits in the lowest parts of the oil system and clogs small oil passages, clearances, and ultimately filters. When sludge is subject to the influence of heat, it will form a hard, gummy substance, usually called lacquer or varnish. This type of sludge causes sticking of valves, mitigates against the continuous operation of oil pumps, and can, of course, seriously interfere with the oil circulation.

4. Liquid contamination, such as unburned fuel from engines, will dilute lubricating oils and possibly reduce their viscosity beyond a safe load-carrying capacity. Conversely, contamination of the lubricant with a heavier oil increases viscosity and interfers with the oil circulation, thereby affecting its lubricating value and heat-transfer capacity.

When the contaminants become too great, the lubricant generally is discarded.

In recent years because of the high price of oil and more stringent anti-pollutio;n standards, there has been increasing interest in reclaiming lubricants for reuse.

We have now discovered that contaminated lubricating oils (i.e., spent lube oil) which usually are discarded can be reclaimed for reuse by a process which comprises:

Treating the lubricant with a surfactant in combination with an amine, more particularly an anionic surfactant in combination with a polyalkylene polyamine. In practice we prefer to employ a salt of an anionic surfactant in combination with polyalkylene amine such as those of the formula $$H_2N\left(-A\overset{H}{N}\right)_n H$$

and where n is an integer such as about 1–12, for example 1–8, such as about 1–5, but preferably about 2–3; A is alkylene such as $(CH_2)_m$ where $m$ is about 2–10, such as about 2–8, but preferably about 2–6.

In carrying out the process, the treating agent is added to the spent lubricant reduced in viscosity, preferably by heating to an elevated temperature, such as about 50° to 200° C., for example from about 90° to 110° C., but preferably from about 80° to 150° C. One method of stirring is to bubble air through the lubricant. Sometimes because of convection currents in the oil it may be difficult for the treated oil to settle very effectively. One means of achieving good settling is to impose super-atmospheric pressure on the vessel. This is conveniently done by closing in the reaction vessel before heating, the vapors evolving on heating being sufficient to impose sufficient super-atmospheric pressure on the system so as to reduce convection currents in the oil which inhibit good settling. Separation of the impurities is achieved by any suitable means such as by gravity, filtration, centrifigations, etc. and combinations thereof.

The surfactant employed herein is preferably anionic, either employed as is or as a salt thereof. The following outlines types of anionic surfactants which can be employed herein.

ANIONIC SURFACTANT

A. Carboxylic acids:
  1. Carboxyl joined directly to the hydrophobic group (subclassification on basis of the hydrophobic group), e.g., fatty acids, soaps, rosin soaps, etc.
  2. Carboxyl joined through an intermediate linkage.
     a. Amide group as intermediate link.
     b. Ester group as intermediate link.
     c. Sulfonamide group as intermediate link.
     d. Miscellaneous intermediate links, ether, $-SO_2-$, $-S-$, etc.

B. Sulfuric esters (sulfates):
  1. Sulfate joined directly to hydrophobic group.
     a. Hydrophobic group contains no other polar structures (sulfated alcohol and sulfated olefin type).
     b. Sulfuric esters with hydrophobic groups containing other polar structures (sulfated oil type).
  2. Sulfate group joined through intermediate linkage.
     a. Ester linkage (artic Syntex M. type).
     b. Amide linkage (Xynomine type).
     c. Ether linkage (Triton 770 type).
     d. Miscellaneous linkages (e.g., oxyalkylamidazole sulfates).

C. Alkane sulfonic acids:
  1. Sulfonic group directly linked
     a. Hydrophobic group bears other polar substituents ("highly sulfated oil" type). Chloro, hydroxy, acetoxy, and olefin sulfonic acids (Nytron type).
     b. Unsubstituted alkane sulfonic acids (MP 189 type; also cetane sulfo acid type).
     c. Miscellaneous sulfonic acids of uncertain structure, e.g., oxidation products of sulfurized olefins, sulfonated rosin, etc.
  2. Sulfonic groups joined through intermediate linkage.
     a. Ester linkage.
        1. $RCOO\ X-SO_3H$ (Igepon AP type).
        2. $ROOC-X-SO_3H$ (Aerosol and sulfo-acetate type).

b. Amide linkage.
   1. RCONH—X—$SO_2H$ (Igepon T type).
   2. RNHOC—X—$SO_3H$ (sulfosuccinamide type).
c. Ether linkage (Triton 720 type).
d. Miscellaneous linkages and two or more linkages.

D. Alkyl aromatic sulfonic acids:
1. Hydrophobic group joined directly to sulfonated aromatic nucleus (subclasses on basis of nature of hydrophobic group. Alkyl phenols, terpene, and rosin-aromatic condensates, alkyl aromatic ketones, etc.).
2. Hydrophobic group joined to sulfonated aromatic nucleus through an intermedite linkage.
   a. Ester linkage (sulfophthalates, sulfobenzoates).
   b. Amide and imide linkages.
      1. R—CONH—$ArSO_3H$ type.
      2. Sulfobenzamide type.
   c. Ether linkage (alkyl phenyl ether type).
   d. Heterocyclic linkage (Ultravon type, etc.).
   e. Miscellaneous and two or more links.

E. Miscellaneous anionic hydrophilic groups:
1. Phosphates and phosphonic acids.
2. Persulfates, thiosulfates, etc.
3. Sulfonamides.
4. Sulfamic acids, etc.

The following are specific examples of representative surfactants: (1) Oxyalkylated alcohols or phenols terminally reacted with sulfamic acid, for example, $R(OA)_nOH$ + sulfamic acid where R is alkyl, aryl, etc.

A typical alcohol is Alfol 8–10 which is a straight chain alcohol having between 8–10 carbons. Reaction with sulfamic acid converts the terminal OH group to the ammonium salt of a sulfate ester. A typical phenol is an oxyalkylated nonyl phenol reacted with sulfamic acid.

Other specific examples are: (1) The disodium salt of sulfonsuccinic acid derived from a $C_{10}$–$C_{12}$ straight chain oxyethylated alcohol.

2. The disodium salt of the half-ester of sulfosuccinic acid derived from a $C_{10}$–$C_{12}$ straight chain oxyethylated alcohol mixture;

3. Disodium salt of sulfosuccinic acid derived from oxyethylated nonyl phenol;

4. Dodecyl benzene sulfonic acid neutralized with ammonia.

A wide variety of polyamines can be employed. Typical polyamines are polyalkylene polyamines, for example, of the formula $$NH_2\left(\overset{H}{A}N\right)_n H$$

as defined above where A is alkylene-straight chain or branched, for example of the formula $$NH_2\left[(CH_2)_m\overset{H}{N}\right]_n H$$

where
$n$=1–10 or more
$m$=2–10 or more.
Typical examples include $$NH_2\left(CH_2\overset{N}{C}H_2N\right)_n H$$

where $n$=1–5 or higher, including mixtures thereof.

$$NH_2\left(CH_2CH_2CH_2\overset{H}{N}\right)_n H$$

where $n$=1–5 or higher or mixtures thereof.

$$NH_2\left(\overset{CH_3}{\overset{|}{-CH}}-CH_2\overset{H}{N}\right)_n H$$

$n$=1–5 or higher or mixtures thereof.

$$NH_2\left[-(CH_2)_6\overset{H}{N}\right]_n H$$

$n$=1–5 or higher or mixtures thereof, etc.

The weight ratio of surfactant to amine will vary depending on many factors such as a weight ratio of 95 to 5 to 5 to 95, such as about 20 to 70, for example, about 70 to 20, but preferably from about 60 to 40.

The amount of treating agent employed will vary widely depending on many factors, from about 0.01% to 5.0% by weight of the oil to be treated, such as from about 0.05 to 4.0%, for example, from about 0.5T to 3.0%, but preferably from about 0.1 to 2.0%. Larger amounts can be employed but generally there is no economical advantage in so doing.

The following are typical treating agents:

EXAMPLE A

| Component | Weight % | Weight % based on Active Ingredients |
|---|---|---|
| Water | 52.52 | |
| Dodecylbenzene sulfonic acid, ammonium salt | 29.16 | 61.4 |
| Mixed polyethylene polyamines* $NH_2(CH_2CH_2\overset{H}{N})_nH$ | 18.32 | 38.6 |

*56% DET n=2
29% TET n=3
7% TEP n=4
5% PEH n=5
3% higher n=>5

EXAMPLE B

The composition of Example A except that $$NH_2\left[(CH_2)_6\overset{H}{N}\right]_2 H$$

is employed in place of the mixed polyalkylene polyamines.

EXAMPLE C

The composition of Example A except the ethylene diamine is employed in place of the mixed polyethylene polyamines.

The following non-limiting examples are presented to illustrate our treating procedures.

Example 1

Spent lube oil was mixed with 0.4% by weight of treating agent based on lube oil and heated to about 95°–100° C. Then the hot treated mixture was centrifuged in a De Luval centrifuge to yield reusable lube oil.

Example 2

Spent lube oil heated to about 115°–120° C. was pumped to a treater to which 2% by weight of treating agent based on lube oil was added. The treater was sealed and placed under a slight super atmosphere by air added at 20 psi (which added to the pressure carried by evolved vapors) for a period of about 2 hours to yield a reusable lube oil.

Example 3

Spent lube oil containing 1% by weight of treating agent based on lube oil was circulated for about 1 hour in a heater at about 80°–85° C. Thereupon it was pumped into a treater which was open to the atmosphere. After a treating period of about 4 hours, reusable lube oil was obtained.

All of the above examples were operable with each of the treating agents of Examples A, B or C.

The reclaimed lube oil was separated from the water and other impurities that settled to the bottom of the treating vessel.

The specific examples set forth above are not intended to limit the invention solely thereto, but to include all variations and modifications within the spirit of this invention.

We claim:

1. A process of reclaiming spent lube oil which comprises treating said spent lube oil with a composition consisting essentially of a surfactant and a polyalkylene polyamine at an elevated temperature, separating the settled impurities and recovering the reclaimed oil.

2. The process of claim 1 where the surfactant is anionic.

3. The process of claim 2 where the anionic surfactant contains a sulfate or a sulfonate radical.

4. The process of claim 3 where the polyalkylene polyamine is predominantly of the formula $$NH_2 \left[ (-CH_2-)_{2-6} \overset{H}{N} \right]_{1-5} H$$

5. The process of claim 4 where the surfactant is an alkylarylsulfonic acid.

6. The process of claim 5 where the alkylarylsulfonic acid is ammonium dodecylbenzenesulfonate.

7. The process of claim 1 wherein said elevated temperature is 50° to 200° C., the weight ratio of surfactant to polyalkylene polyamine is between 95 to 5 and 5 to 95 and the amount of treating composition employed is from about 0.02% to 5.0% by weight of the oil treated.

8. The process of claim 6 where said composition contains water.

9. The process of claim 8 where the polyalkylene polyamine is predominantly $$NH_2 \left( CH_2CH_2\overset{H}{\overset{|}{N}} \right)_{1-5} H$$

10. The process of claim 8 where the polyalkylene polyamine is predominantly $$NH_2 \left( (CH_2)_6\overset{H}{\overset{|}{N}} \right)_2 H.$$

* * * * *